US007984595B2

(12) United States Patent
Reen

(10) Patent No.: US 7,984,595 B2
(45) Date of Patent: Jul. 26, 2011

(54) FLOOR HOLE REPAIR FIXTURE

(76) Inventor: Michael J. Reen, Wilmington, DE (US)

( * ) Notice: Subject to any disclaimer, the term of this patent is extended or adjusted under 35 U.S.C. 154(b) by 0 days.

(21) Appl. No.: 12/687,916

(22) Filed: Jan. 15, 2010

(65) Prior Publication Data

US 2010/0115873 A1 May 13, 2010

Related U.S. Application Data

(63) Continuation-in-part of application No. 11/765,823, filed on Jun. 20, 2007, now Pat. No. 7,665,272.

(51) Int. Cl.
*E02D 37/00* (2006.01)

(52) U.S. Cl. ..... 52/514.5; 52/514; 52/232; 264/35; 29/402.01

(58) Field of Classification Search ..... 52/514, 52/232, 514.5, 742.14, 742.16, 220.8, 317, 52/220.1; 264/35, 36.1, 36.2; 156/94; 425/11; 29/402.01, 402.02, 402.09, 402.18, 464
See application file for complete search history.

(56) References Cited

U.S. PATENT DOCUMENTS

| | | | | |
|---|---|---|---|---|
| 458,880 | A | 9/1891 | Wissler | |
| 2,249,824 | A * | 7/1941 | Hall | 249/177 |
| 2,471,301 | A | 5/1949 | Boosey | |
| 2,598,194 | A | 5/1952 | Shippey | |
| 2,684,518 | A | 7/1954 | Whitlock | |
| 2,728,126 | A | 12/1955 | Whitlock | |
| 3,198,553 | A | 8/1965 | Fladung | |
| 3,265,349 | A * | 8/1966 | Hamrick | 249/177 |
| 3,289,374 | A | 12/1966 | Metz | |
| 3,294,358 | A | 12/1966 | Hagedorn | |
| 3,346,230 | A * | 10/1967 | Tolf, Jr. | 249/177 |
| 3,675,807 | A * | 7/1972 | Lund et al. | 220/3.94 |
| 3,690,084 | A | 9/1972 | Leblanc | |
| 3,736,713 | A | 6/1973 | Flachbarth et al. | |
| 4,170,853 | A | 10/1979 | Kohaut | |
| 4,261,598 | A | 4/1981 | Cornwall | |
| 4,270,318 | A | 6/1981 | Carroll et al. | |
| 4,273,879 | A | 6/1981 | Langer et al. | |
| 4,364,210 | A * | 12/1982 | Fleming et al. | 52/220.8 |
| 4,432,465 | A | 2/1984 | Wuertz | |
| 4,493,173 | A | 1/1985 | Kohaut | |
| 4,693,652 | A * | 9/1987 | Sweeney | 411/23 |
| 4,697,396 | A | 10/1987 | Knight | |
| 4,807,415 | A | 2/1989 | Oak | |
| 4,809,478 | A | 3/1989 | Bernard | |
| 4,827,539 | A * | 5/1989 | Kiziah | 4/252.4 |

(Continued)

OTHER PUBLICATIONS

HILTI CP 642 Fire Stop Jacket product information, www.hilti.com (undated).

(Continued)

*Primary Examiner* — Robert J Canfield
*Assistant Examiner* — Matthe J. Gitlin
(74) *Attorney, Agent, or Firm* — Connolly Bove Lodge & Hutz LLP

(57) ABSTRACT

A floor hole repair fixture has at least one vertical side wall and a bottom wall which together define an inner volume. The fixture is connected to a hole in a floor with one or more fasteners and is filled with a non-shrink grout. A depending rim or flange extending from the at least one side wall helps seat the fixture within the hole. Intumescent material may be coated onto or applied to external fixture surfaces before the fixture is inserted into the hole. Floor covering material is installed over the grout-filled fixture.

14 Claims, 3 Drawing Sheets

U.S. PATENT DOCUMENTS

| | | | |
|---|---|---|---|
| 4,850,385 | A | 7/1989 | Harbeke |
| 4,888,925 | A | 12/1989 | Harbeke |
| 4,905,429 | A | 3/1990 | Fukushima et al. |
| 4,916,800 | A | 4/1990 | Harbeke |
| 4,930,281 | A | 6/1990 | Martin et al. |
| 5,035,097 | A | 7/1991 | Cornwall |
| 5,040,351 | A | 8/1991 | Cornwall |
| 5,129,135 | A | 7/1992 | Yoshino |
| 5,144,777 | A | 9/1992 | Fishel et al. |
| 5,231,810 | A | 8/1993 | Buhay et al. |
| 5,301,475 | A | 4/1994 | Stefely |
| 5,438,809 | A | 8/1995 | Ehrlich |
| 5,503,164 | A | 4/1996 | Friedman |
| 5,556,688 | A | 9/1996 | Cox |
| 5,661,264 | A | 8/1997 | Reiker |
| 5,887,395 | A | 3/1999 | Navarro et al. |
| 5,921,041 | A | 7/1999 | Egri, II |
| 5,970,670 | A | 10/1999 | Hoffman |
| 5,974,750 | A | 11/1999 | Landin et al. |
| 6,088,972 | A | 7/2000 | Johanneck |
| 6,088,986 | A | 7/2000 | DiGate |
| 6,112,488 | A | 9/2000 | Olson et al. |
| 6,161,873 | A | 12/2000 | Munzenberger et al. |
| 6,253,987 | B1 | 7/2001 | Coletta et al. |
| 6,634,034 | B2 | 10/2003 | Rendell |
| 6,694,684 | B2 | 2/2004 | Radke et al. |
| 6,698,146 | B2 | 3/2004 | Morgan et al. |
| 6,783,345 | B2 | 8/2004 | Morgan et al. |
| 6,820,382 | B1 * | 11/2004 | Chambers et al. ..... 52/232 |
| 6,896,394 | B2 * | 5/2005 | Houle ..... 362/365 |
| 7,018,699 | B2 | 3/2006 | Dykhoff |
| 7,043,880 | B2 | 5/2006 | Morgan et al. |
| 7,053,296 | B2 | 5/2006 | Drane et al. |
| 7,078,616 | B2 | 7/2006 | Roesch et al. |
| 7,080,486 | B2 | 7/2006 | Radke et al. |
| 2001/0048985 | A1 | 12/2001 | Legare |
| 2004/0157012 | A1 | 8/2004 | Miller et al. |
| 2005/0155305 | A1 | 7/2005 | Cosenza et al. |
| 2005/0181693 | A1 | 8/2005 | Kajander |
| 2006/0053710 | A1 | 3/2006 | Miller et al. |
| 2007/0138789 | A1 | 6/2007 | Muenzenberger et al. |

OTHER PUBLICATIONS

3M Fire Barrier Pass-through Device prodict information (undated).
3M CS-195+ Composite Sheet product information (undated).

* cited by examiner

Fig.1. (PriorArt)
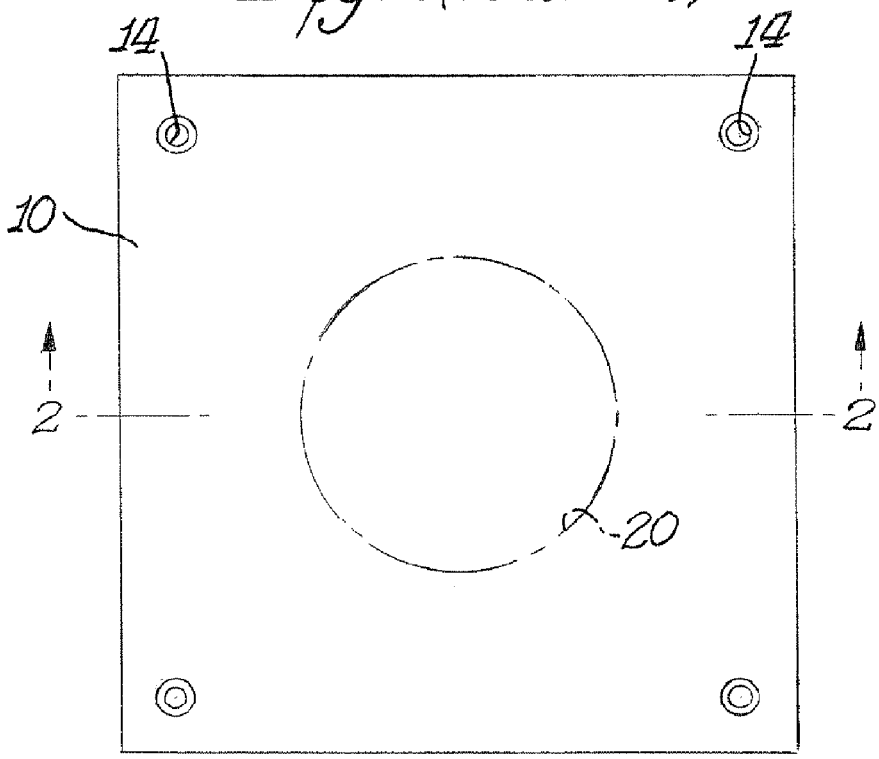
Fig.2. (PriorArt)
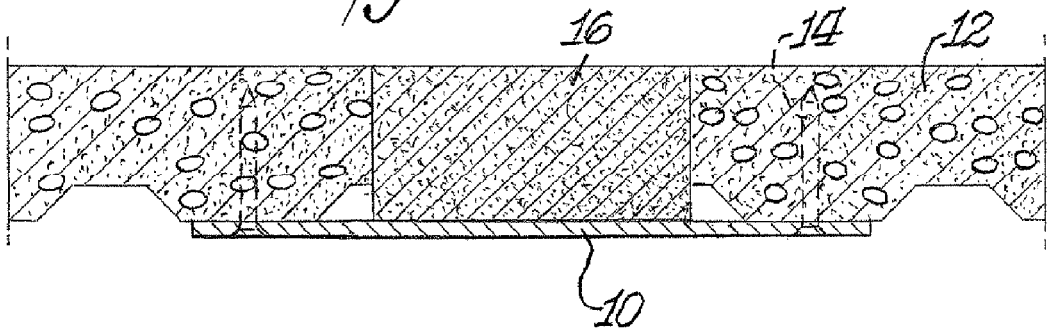

FLOOR HOLE REPAIR FIXTURE

CROSS-REFERENCE TO RELATED APPLICATION

This application is a divisional of U.S. patent application Ser. No. 11/765,823, filed Jun. 20, 2007, which is, now U.S. Pat. No. 7,665,272, the contents of which are incorporated herein by reference.

FIELD OF THE INVENTION

This invention relates to a floor hole repair fixture and method with particular advantage for commercial or industrial buildings having an elevated concrete deck floor.

BACKGROUND OF THE INVENTION

Many commercial buildings with multiple stories have concrete deck floor support for each floor above ground level. Holes may be formed through such deck floor support to permit passage of conduit for cables or piping installed to supply various utility and information technology services throughout the commercial building. Building codes and fire regulations require use of certain insulation, barriers and intumescent coatings to retard the spread of fire from one floor to another.

When the building owner or occupant/tenant desires to change a floor layout, such that cables and piping or conduit are relocated from one location to another, an open hole or core hole through the concrete deck forming the floor may be left that previously was occupied by cables, piping or conduit. Such hole must be repaired before new flooring material, such as tile, laminate or carpet may be installed over the concrete deck floor.

Referring to FIGS. 1 and 2, a known prior art method for repairing a hole 20 is illustrated. A plate 10 is affixed to the undersurface of the concrete deck 12 with a series of fasteners 14, such as concrete anchor screws. Grout 16 is packed into the hole volume. Then, new flooring material (not shown) may be installed over the top surface of the concrete deck 12 and the grout-filled hole 20. Such floor hole repair system frequently leads to undesired depressions or defects in the flooring material due to settling or shrinking of the grout 16 and/or due to movement of the plate 10. Such floor hole repair system lacks a fire barrier often required by building codes and fire prevention regulations applicable to commercial buildings.

Many commercial buildings are renovated for alternate uses. Many commercial buildings, such as hospitals, are renovated to increase capacity or introduce alternative equipment or services. Contractors and construction personnel continue to seek alternate systems and methods to repair core holes in concrete flooring.

SUMMARY OF THE INVENTION

In a first aspect of the invention, a method for repairing a hole in a floor includes the steps of (a) providing a floor hole repair fixture defining an inner volume and having a depending rim; (b) connecting the fixture to at least one side surface of the hole; and (c) substantially or completely filling the inner volume of the fixture with grout. The method may further include the step of (d) seating the fixture within the hole so that the depending rim seats over a portion of flooring surface adjacent to the hole. Where such rim is so seated, it may be affixed to the portion of the flooring surface with one or more fasteners. Fasteners may also be used to connect the fixture to the at least one side surface of the hole. The method may further include the steps of (e) applying a skim coat over the upper rim of the fixture and over a portion of flooring surface adjacent to the hole; and (f) installing a flooring material over at least the rim of the floor hole repair fixture. To better meet fire and safety codes, preferably at least a portion of the outer surface of the fixture is coated with an intumescent coating, either at the factory or before the fixture is installed within the hole.

In a second aspect of the invention, a floor hole repair fixture has at least one side wall; a rim depending from the side wall; a bottom, wherein the at least one side wall and bottom define an inner volume to hold a grout material when such fixture is installed inside a floor hole. Preferably, the fixture has a bottom wall and a vertical side wall that is generally cylindrically shaped. The vertical side wall and bottom wall define an inner generally cylindrical volume to hold a grout material. The rim may depend from the upper portion of the side wall and form a ring. An intumescent coating may be applied to or formed on an outer surface of the at least one side wall and on an outer surface of the bottom. In one embodiment, the at least one side wall, rim and bottom of the fixture are formed integrally from high strength material, such as metal, preferably steel. To make it easier to install the floor hole repair fixture within a hole in a floor deck, such as a concrete floor deck, one or more holes may be pre-formed in the sidewall and in the rim. Such holes are adapted to receive fasteners for joining the floor hole repair fixture to the floor deck.

DESCRIPTION OF THE DRAWINGS

FIG. 1 is a bottom plan view of a floor hole repair system according to the prior art;

FIG. 2 is a cross sectional view in side elevation of the floor hole repair system taken along line 2-2 in FIG. 1;

DETAILED DESCRIPTION OF PREFERRED EMBODIMENTS

Figure 4:
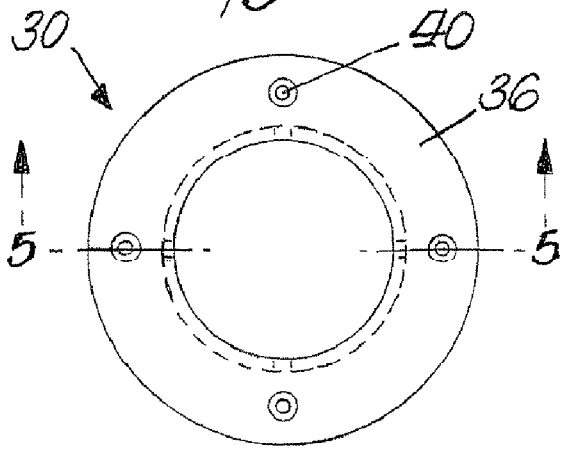
FIG. 4 is a top plan view of a floor hole repair fixture of FIG. 3.
Figure 3:
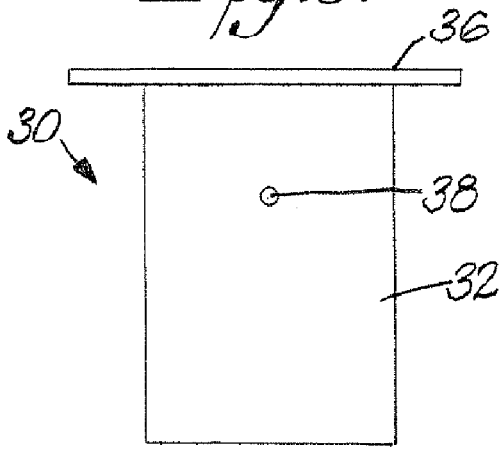
FIG. 3 is a front elevational view of a floor hole repair fixture according to the invention.

Referring to FIGS. 3-6, a floor hole repair fixture 30 according to an embodiment of the invention has a sidewall 32 defining a generally cylindrical volume and a bottom wall 34. The bottom wall 34 in the embodiment shown in FIG. 4 has a generally circular shape with a diameter. The diameter of the bottom wall 34 may be provided in different sizes to accommodate repairs to different size holes in deck flooring. One suitable size range for the bottom wall diameter is from 2 inches to 6 inches, preferably in the range from 2.75 inches to 5.75 inches. The sidewall has a height that is comparable to the thickness of the flooring deck in the floor to be repaired. A suitable sidewall height can be, for example, about 4 inches.

A generally circular rim 36 or flange depends from the upper portion of the sidewall 32. The rim 32 has a generally flat upper surface and a generally flat bottom surface. As such, the floor hole repair fixture 30 somewhat resembles an upside-down top hat with the rim 36 comparable to the brim of such top hat. The rim 36 is wide enough to seat the fixture 30 within a hole in a flooring deck such that the rim 36 helps to prevent the fixture 30 from passing through the hole. For example, the rim 36 may have a width in the range of about 1 to 2 inches, preferably about 1.5 inches.

A series of holes 38 are formed through the sidewall 32. The holes 38 receive fasteners (not shown in FIGS. 4-6) when the floor hole repair fixture 30 is seated within a hole to be repaired.

A series of holes 40 are formed through the rim 36. The holes 40 receive fasteners (not shown in FIGS. 4-6) when the floor hole repair fixture 30 is seated within a hole to be repaired.

The floor hole repair fixture 30 may be formed from a single sheet of material stamped or formed to the desired fixture shape. For example, the floor hole repair fixture may be body stamped from a single sheet of material, such as, for example, a sheet of 10-gauge steel. Alternatively, the floor hole repair fixture may be formed from separate rim and sidewall components joined together.

Figure 5:
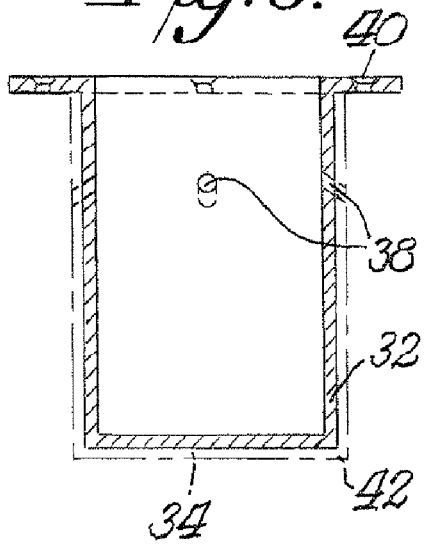
FIG. 5 is a cross-sectional view of the floor hole repair fixture of FIG. 4 taken along line 5-5, and to which an intumescent coating (shown in phantom outline) has been applied.
Figure 6:
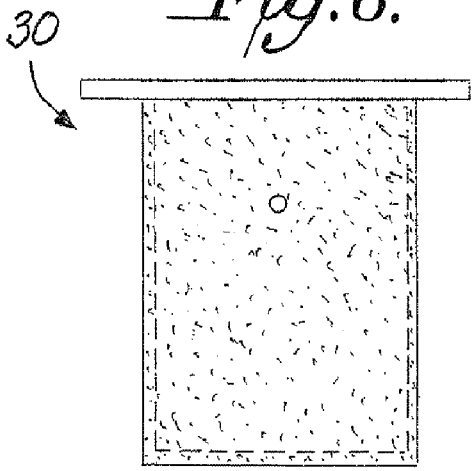
FIG. 6 is a side elevational view of the floor hole repair fixture of FIG. 4 to which intumescent coating has been applied.

Since many of the core holes to be repaired in concrete deck flooring are generally circular or round holes, the embodiment shown in FIGS. 4-6 has a single sidewall and a bottom wall that is circular so that the fixture takes on a generally cylindrical shape. However, alternative shapes for the floor hole repair fixture are contemplated herein. Where the floor hole to be repaired has a shape other than circular, the floor hole repair fixture may be formed complementary to said hole shape so that such fixture with fit within such hole. Thus, fixtures complementary to fit within generally square, rectangular, and other regular and irregular geometric shaped holes are contemplated herein.

An intumescent coating 42 is formed on or applied to the outer surface of the sidewall 32 and the outer surface of the bottom wall 34 of the floor hole repair fixture 30 (see FIGS. 5-6). The coating may be factory-applied prior to shipping the fixture to a customer. Alternatively, the customer who is repairing the floor may as a first step spray or apply the coating to the outer surfaces of the sidewall 32 and bottom wall 34 of the floor hole repair fixture 30. The coating thickness is generally from 1/16 to 1/4 inch, preferably about 1/8 inch. Suitable intumescent coatings include those sprayable or paintable coatings approved by local building codes. Fire shielding materials for intumescent coatings include HILTI CP 672 Firestop Joint Spray or 3M Fire Barrier Water Tight Silicone Sealant 3000 WT.

Figure 7:
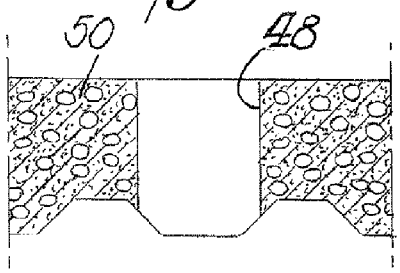
FIG. 7 is a cross-sectional view of a hole in a concrete deck floor.

FIGS. 7 to 11 illustrate a method for repairing a floor hole in a concrete deck floor using a floor hole repair fixture 30 according to the invention. Referring first to FIG. 7, a hole 48 is present through a concrete floor 50. The hole 48 has a generally circular cross-section and defines an open passageway through the thickness of the concrete floor 50. Building codes do not permit flooring material, such as tile, laminates or carpeting to be installed over the concrete floor 50 containing such a hole 48 unless the hole 48 is first repaired.

Figure 8:
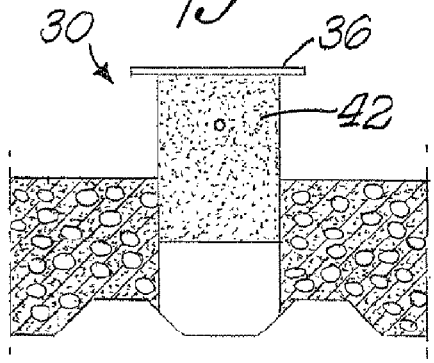
FIG. 8 is a view in partial cross-section showing a floor hole repair fixture inserted into the hole in the concrete floor.

In FIG. 8, as a first step, a floor hole repair fixture 30 having a bottom wall with a circular diameter of a size comparable to the diameter of the hole 48 is inserted into the hole 48. Before such insertion, the floor hole repair fixture 30 has been coated with an intumescent coating 42 at least on the outer surfaces of the sidewall 32 and bottom wall 34. The floor hole repair fixture 30 has a depending rim 36 or flange that will rest over or contact the upper surface of the concrete floor deck 50. Preferably, the outer sidewalls of the fixture fit snugly within the hole, with such close tolerance that it may be required to tap the fixture 30 into the hole with a wooden mallet or hammer.

Figure 9:
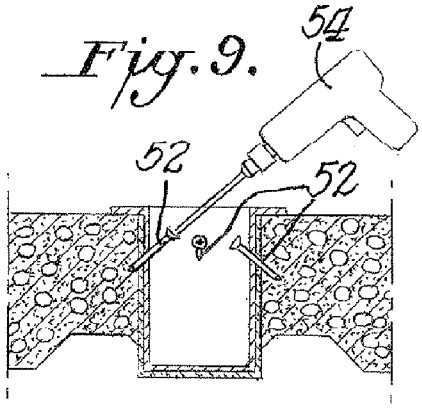
FIG. 9 is a view in partial cross-section showing one way to connect the floor hole repair fixture to the concrete floor, such as with anchor screws.

Once the floor hole repair fixture 30 is seated within the hole 48, it is then connected or fastened to the concrete forming the floor 50 with a series of fasteners 52. As shown in FIG. 9, each fastener 52 is inserted through a hole 38 in the sidewall 32 of the fixture 30 and into the concrete floor 50 with an impact wrench 54 or other concrete anchor installation tool. The fasteners 52 are not completely forced into the concrete. A portion of each fastener 52 remains within the inner volume of the fixture 30.

Fasteners 52 suitable for joining materials to concrete can be used. Representative fasteners include HILTI or TAPCON concrete anchors. Such concrete anchors have a hexagonal head diameter of 3/8 inch or 1/2 inch or 5/8 inch and a length of about 2 to 6 inches. Such concrete anchors are screwed into the concrete leaving about 1/4 of their length within the inner volume of the fixture 30.

Figure 10:
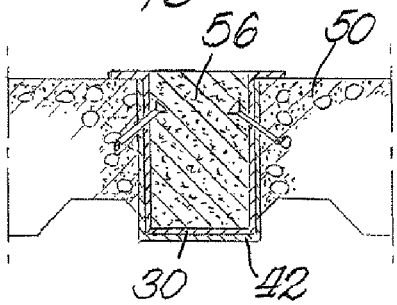
FIG. 10 is a view in partial cross section wherein grout compound has been packed into the seated floor hole repair fixture.
Figure 11:
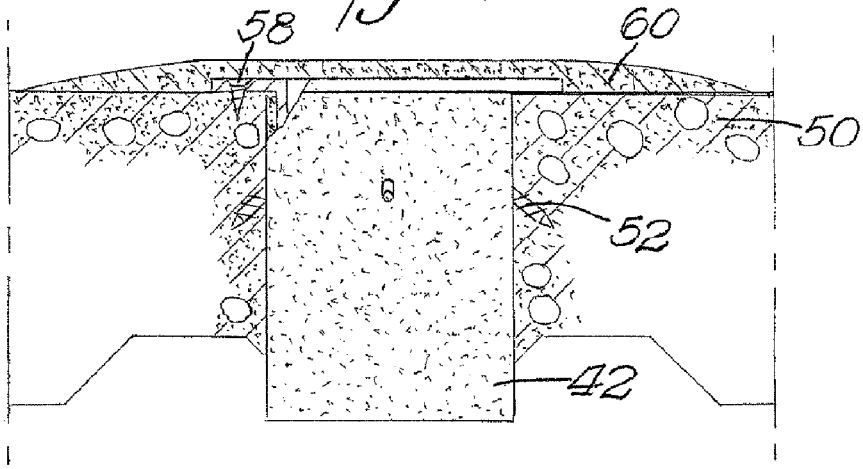
FIG. 11 is a view in partial cross-section in which a skim coat has been applied over the floor hole repair fixture filled with cured grout compound in preparation for installing a flooring surface thereover.

Referring next to FIG. 10, the inner volume of the fixture 30 is then filled with a nonshrink grout 56. Such grout 56 stabilizes the repair fixture and provides an air and fire barrier. The heads of the fasteners 52 exposed within the inner volume of the fixture 30 help to keep the grout in place within the fixture 30. One suitable grout material is pre mix QUIKRETE Precision High Strength non-shrink grout Additional fasteners 58 can be used to connect the rim 36 or flange of the floor hole repair fixture 30 to the upper floor surface 50. Such fasteners 58 may be concrete anchor screws of the same or different length as the fasteners 52 that connect the fixture 30 to the sides of the hole 48. As shown in FIG. 11, the additional fasteners 58 are shorter length. Such fasteners 58 are particularly helpful to keep the rim 36 in place before patching or further coating the flooring surface.

Also shown in FIG. 11 is a skim coat 60 applied over the floor 50 surface, rim 36 and grout 56 held within the fixture 30. The skim coat 60 is applied after the grout 56 has cured. The skim coat 60 provides a smooth finish to the substrates prior to floor covering installation. One suitable skim coat material is ARDEX FEATHER FINISH, a self-drying, cement-based finishing underlayment.

Once the skim coat 60 has dried sufficiently, a floor covering, such as tile, laminate, or carpet underlayment and carpeting may be installed over the floor hole repair fixture.

Such floor hole repair system offers advantages over the prior art repair system of FIGS. 1-2. The fixture 30 maintains the grout within the hole 50 more stably and predictably than the prior procedure. The fixture has intumescent coating to prevent flames from crossing between floors through the hole. The new floor installation thus has greater support and offers better fire protection.

The invention has been illustrated by detailed description and examples of the preferred embodiments. Various changes in form and detail will be within the skill of persons skilled in the art. Therefore, the invention must be measured by the claims and not by the description of the examples or the preferred embodiments.

I claim:

1. A floor hole repair fixture to fill a pre-existing floor hole, comprising:

a cup monolithically formed from one material, said cup defining an inner volume to hold a grout material when the fixture is installed inside a floor hole, said cup having a closed bottom at one end and an open end opposite from the closed bottom, wherein the cup has at least one upstanding sidewall extending from the closed bottom, said sidewall defining an inner surface and an outer surface, said sidewall further defining one or more holes therethrough for receiving fasteners to join the cup to a side portion of the pre-existing floor hole; and a depending rim extending radially outwardly from the top portion of the sidewall, said rim having a top surface and a bottom surface and defining one or more holes to receive fastener(s), wherein when the fixture is installed inside the pre-existing floor hole, the bottom surface of said rim seats on an upper surface of a floor outside of the pre-existing floor hole, and the top surface of said rim faces away from the upper surface of the floor and the floor hole, and the cup is inside the pre-existing floor hole with the outer surface of the sidewall contacting the side portion of the pre-existing floor hole.

2. The floor hole repair fixture of claim 1, further comprising:

an intumescent coating applied to or formed on an outer surface of the at least one sidewall.

3. The floor hole repair fixture of claim 1, further comprising an intumescent coating applied to or formed on an outer surface of the cup.

4. The floor hole repair fixture of claim 1, wherein the rim forms a ring around the open end of said cup.

5. The floor hole repair fixture of claim 1, further comprising grout introduced into the inner volume of said cup.

6. A floor hole repair kit to fill a pre-existing floor hole, comprising:

a floor hole repair fixture having at least one side wall defining an open end at a top portion, said sidewall further defining one or more holes therethrough for receiving fasteners to join the fixture to a side portion of the pre-existing floor hole, a bottom monolithic with the sidewall and forming a closed end opposite from the open end, and a depending rim extending from the top portion of the at least one side wall, said rim having a top surface and a bottom surface, wherein the bottom surface is adapted to contact a floor surface when the fixture is installed inside a floor hole and the top surface faces away from the floor hole, wherein the at least one side wall and bottom together define an inner volume to hold a grout material when such fixture is installed inside the floor hole, and wherein an intumescent coating is applied to or formed on an outer surface of the at least one side wall;

grout material in an amount at least sufficient to fill the inner volume of the fixture; and one or more fasteners.

7. The floor hole repair kit of claim 6, wherein the rim forms a ring.

8. The floor hole repair kit of claim 6, wherein the rim defines one or more holes to receive fastener(s).

9. The floor hole repair kit of claim 6, wherein the at least one side wall and bottom define an inner generally cylindrical volume.

10. A floor hole repair fixture to fill a pre-existing floor hole, comprising:

a cup monolithically formed from one material, said cup defining an inner volume to hold a grout material when the fixture is installed inside a floor hole, said cup having a closed bottom at one end and an open end opposite from the closed bottom, wherein the cup has at least one upstanding sidewall extending from the closed bottom, said sidewall defining an inner surface and an outer surface, said sidewall further defining one or more holes therethrough for receiving fasteners to join the cup to a side portion of the pre-existing floor hole; and a depending rim extending radially outwardly from the top portion of the sidewall, said rim having a top surface and a bottom surface, and an intumescent coating applied to or formed on an outer surface of the cup, wherein when the fixture is installed inside the pre-existing floor hole, the bottom surface of said rim seats on an upper surface of a floor outside of the pre-existing floor hole, and the top surface of said rim faces away from the upper surface of the floor and the floor hole, and the cup is inside the pre-existing floor hole with the outer surface of the sidewall contacting the side portion of the pre-existing floor hole.

11. The floor hole repair fixture of claim 10, wherein the intumescent coating is applied to or formed on an outer surface of the at least one sidewall.

12. The floor hole repair fixture of claim 10, wherein the rim defines one or more holes to receive fastener(s).

13. The floor hole repair fixture of claim 10, wherein the rim forms a ring around the open end of said cup.

14. The floor hole repair fixture of claim 10, further comprising grout introduced into the inner volume of said cup.

* * * * *

UNITED STATES PATENT AND TRADEMARK OFFICE

CERTIFICATE OF CORRECTION

PATENT NO. : 7,984,595 B2
APPLICATION NO. : 12/687916
DATED : July 26, 2011
INVENTOR(S) : Michael J. Reen It is certified that error appears in the above-identified patent and that said Letters Patent is hereby corrected as shown below:

On the cover page:

(63) Related U.S. Application Data should read --Divisional of application No. 11/765,823, filed on Jun. 20, 2007, now Pat. No. 7,665,272 --, not "Continuation-in-part."

Signed and Sealed this
Thirteenth Day of September, 2011

David J. Kappos

David J. Kappos
*Director of the United States Patent and Trademark Office*